United States Patent [19]

Croft et al.

[11] 4,300,317

[45] Nov. 17, 1981

[54] METHOD OF FITTING OPHTHALMIC LENSES IN SPECTACLES FRAMES

[75] Inventors: George T. Croft, Fiskdale; Rato R. Buhler, Dudley, both of Mass.

[73] Assignee: American Optical Corporation, Southbridge, Mass.

[21] Appl. No.: 111,052

[22] Filed: Jan. 10, 1980

[51] Int. Cl.[3] ..... B24B 1/00; B24B 9/14

[52] U.S. Cl. ..... 51/284 E; 51/101 LG; 33/200

[58] Field of Search ..... 51/101 LG, 283 E, 284 E; 409/84; 76/110; 33/174 A, 200

[56] References Cited

U.S. PATENT DOCUMENTS

| | | | |
|---|---|---|---|
| 2,674,068 | 4/1954 | Eves | 51/101 LG |
| 2,685,153 | 8/1954 | Ellis | 51/284 E X |
| 3,119,206 | 1/1964 | Baumgartner | 51/101 LG |
| 3,170,374 | 2/1965 | Clar | 409/84 |
| 3,405,482 | 10/1968 | Brandt | 51/101 LG |
| 3,555,739 | 1/1971 | Novak | 51/101 LG |
| 3,672,855 | 6/1972 | Bright | 51/101 LG |
| 3,786,600 | 1/1974 | Bloxsom | 51/101 LG |
| 3,899,851 | 8/1975 | Asselm | 51/101 LG |
| 4,012,991 | 3/1977 | Uyeda | 409/84 X |
| 4,027,434 | 6/1977 | Haddock | 51/101 LG |
| 4,051,601 | 10/1977 | Godot | 33/200 X |
| 4,096,684 | 6/1978 | Akaba | 51/101 LG |

*Primary Examiner*—Nicholas P. Godici

*Attorney, Agent, or Firm*—Alan H. Spencer

[57] ABSTRACT

Glazing spectacles frames with correction of attending lens rim distortions by measuring the inner perimeter of the rims and edging the lenses to the measured perimetric size and proper pattern shape. Insertion of the edge lenses into the measured lens rims will cause the rims to conform to the edged lens profile and correct preexistent rim distortions.

7 Claims, 5 Drawing Figures

METHOD OF FITTING OPHTHALMIC LENSES IN SPECTACLES FRAMES

BACKGROUND OF THE INVENTION

1. Field of the Invention

Spectacles frame glazing with particular reference to improvements in method and apparatus for measuring and fitting lenses in spectacles lens rims of molded, cast and/or machined plastic materials.

2. Discussion of the Prior Art

Ophthalmic lenses are edged to fit the rims of spectacles frames with machines using patterns which are provided by the frame manufacturer or made up from the spectacles frames as disclosed in U.S. Pat. No. 3,170,374, for example. Alternatively, the spectacles rims themselves may function as the edging pattern as in U.S. Pat. No. 3,899,851 or 4,027,434. Other examples of the latter procedure can be seen in U.S. Pat. Nos. 3,555,739; 3,672,855; 3,786,600; and 4,096,684.

In the above cases distortion in spectacles lens rims, e.g. oversize in one meridian and undersize in another and/or irregularities such as unintended bends, are duplicated in the edged lens which leaves the finally glazed frame uncorrected, i.e. with its original variations from nominal size and/or shape.

Other lens edging procedures which rely upon lens size measurement taken across the lens rim opening do not reflect frame distortions and similarly lead to poorly glazed frames when variations between actual and nominal frame shapes occur.

In view of the foregoing, it is an object of this invention to provide novel method and apparatus for use in glazing spectacles frames with corrections of variations between actual and nominal frame shapes, i.e. to provide method and apparatus for measuring correct spectacles lens size independently of rim irregularities.

Other objects and advantages of the invention will become apparent from the following description.

SUMMARY OF THE INVENTION

Objectives of the invention are accomplished by measuring the inner perimeter of a spectacles rim rather than its diameter or tracing its actual shape. Edging machine lens size adjustments are made according to the perimetric measurement and a standard lens edging pattern is used to control the final lens shape. Plastic spectacles glazing with a lens so edged causes the receiving rim to conform to the correct lens shape.

Details of the invention will become more readily understood by reference to the following description when taken in conjunction with accompanying drawings.

IN THE DRAWINGS

DESCRIPTION OF THE PREFERRED EMBODIMENTS

Figure 1:
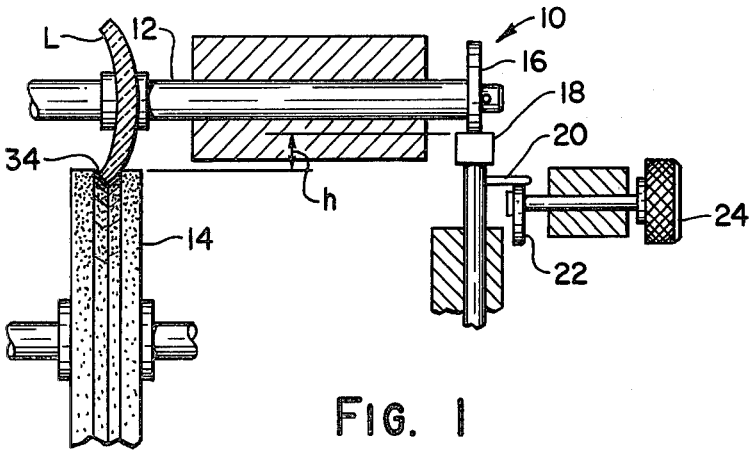
FIG. 1 is a diagrammatic illustration of a form of lens edging apparatus to which the present invention is applicable.

Machine 10 (FIG. 1) is exemplary of apparatus used to edge lenses to the various sizes and shapes required in the art of glazing spectacles frames. A lens L to be edge is clamped in arbor 12 which is rotated about its axis and moved toward and away from grinding wheel 14 as needed to produce an edge shape suitable for glasing. Replaceable pattern 16, riding on shoe 18, regulates the movement of lens L toward and away from wheel 14 in conventional fashion.

Relative heights h of wheel 14 and shoe 18 determine the ultimate size to which lens L may be edged and shoe 18 is rendered adjustable for the purpose. To this end, there is provided stop 20 on shoe 18 which is engaged by rotatable cam 22 having operating knob 24.

In view of the present invention being directed more particularly to matters of measuring spectacles rims for edging (i.e. to determine proper lens size settings needed to be made with knob 24) further details of apparatus 10 will not be discussed herein. Those interested in such details, however, may refer to one or more of U.S. Pat. Nos. 2,674,068; 3,119,206 and 3,405,482.

According to the invention, the inner perimeter of a plastic or thin metal spectacles rim 26 (FIGS. 2 & 3) to be glazed is measured for determination of proper size setting of machine 10, given a pattern 16 of known perimetric dimension and having a profile, i.e. edge contour, corresponding to that required for final accurate glazing of rim 26.

By accurate glazing profile it is meant a lens L shape of proper preselected edge contour and perimetric dimension equal to that of the inner edge of rim 26 whether the unglazed rim may be oversized in one meridian and/or undersized in another meridian or otherwise distorted from an intended final shape.

In one aspect of the present invention (FIG. 2), the spectacles frame F to be measured in rotated 360° about roller 28 carried by spring biased arm 30 which, in turn, is mounted in stationary support 32.

By such means, the inner perimeter P of rim 26 may be determined from the expression $P=q\ d\pi$ where q equals the number of roller rotations and d equals the roller diameter.

Typically, with a roller 28 of $$d = \frac{20\text{mm}}{\pi}$$

and an encoder with 200 steps per revolution, the perimeter P could be measured with an accuracy of 0.1 mm. A suitable commercial encoder is a product of Disc Instruments Inc. of Costa Mesa, California USA which is identified as Rotoswitch—200 Incremental Shaft Encoder.

In the art of lens edging, patterns 16 are usually of a size smaller than the largest lens to be edged so that a single pattern 16 can be used to edge lenses to various "eye" sizes, all with the same contour shape.

Accordingly, with knowledge of the perimetric size of a lens pattern 16 selected for use and the measured inner perimeter of a spectacles rim to be glazed, edging apparatus such as machine 10 may be adjusted with knob 24 to a setting where the respective levels of shoe 18 and uppermost grinding edge 34 of wheel 14 will cause pattern 16 to allow lens L only enough reach, i.e.

from its axis of rotation toward edge 34 of wheel 14, to effect grinding to the shape of pattern 16.

Figure 2:
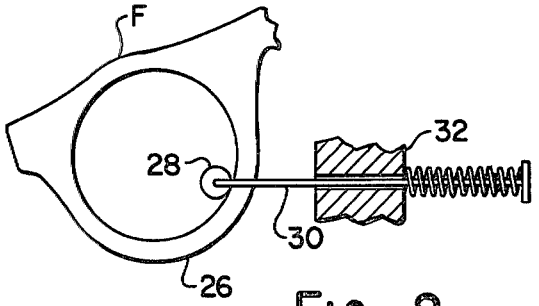
FIG. 2 is a fragmentary plan view of a preferred embodiment of the invention.
Figure 4:
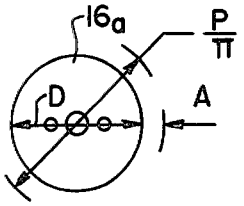
FIGS. 4 & 5 illustrate a technique for determining edging machine size setting adjustment according to principles of the present invention, the irregularities of shape in FIG. 5 being exaggerated for purposes of illustration.
Figure 5:
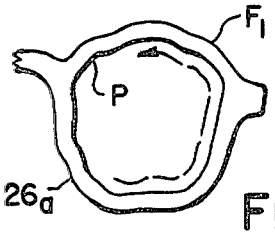

FIGS. 4 & 5 illustrate the simplest form of lens and spectacles rim shape, i.e. circular, and where the adjustment A that would be needed for setting an edging machine pattern shoe 18 can be determined as follows:

Considering spectacles frame $F_1$ (FIG. 5) as needing to be glazed with a circular lens in spite of its irregular unglazed shape, the inner periphery P is measured (e.g. as in FIG. 2). Knowing the Periphery P of frame rim $\mathbf{26}_a$ and diameter D of a selected pattern $\mathbf{16}_a$, the distance A which pattern shoe 18 is required to be moved above the level of wheel edge 34 (i.e. height h) may be determined from $A=\frac{1}{2}$ $$\left(\frac{P}{\pi} - D\right).$$

Thus with a lens L edged to diameter $$\frac{P}{\pi},$$

its insertion in rim $\mathbf{26}_a$ (FIG. 5) will cause the rim to assume a proper tight-fitting circular configuration about the lens with the FIG. 5 irregularities eliminated, i.e. straightened out.

The glazing of a plastic spectacles frame is usually carried out with an application of heat to the frame for ease of insertion of the lens and straightening of rim irregularities. Heating to within a range of from 200° F. to 300° F. will produce desirable results.

The aforesaid adjustment A for other spectacles rim and lens shapes would be similarly mathematically calculated.

It should be understood, however, that the inner periphery of spectacles rims are commonly grooved, e.g. to receive the beveled edge of lenses such as lens L in FIG. 1. Accordingly, roller 28 in either FIG. 2 or FIG. 3 may be provided with a complimentary V-shaped tracking edge. Where other forms of rim channeling are encountered, correspondingly shaped roller edges may be provided.

Figure 3:
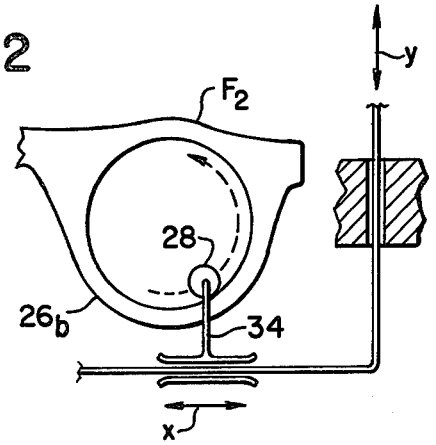
FIG. 3 is an illustration of a modification of the frame measuring apparatus of FIG. 2.

In the modification of the invention shown in FIG. 3, the spectacles frame $F_2$ is held stationary and roller 28 is guided along the rim 26 through a full loop. Roller support 34 is arranged to move universally in the illustrated x and y directions and measurement of the perimeter of rim $\mathbf{26}_b$ equals $d\pi\ (g+1)$ where d=roller diameter and q=number of roller rotations.

While the number of roller rotations may be determined visually, it is preferable to incorporate an encoder, e.g. of the type mentioned above.

It will become apparent to those skilled in the art that there may be other modifications and adaptations of the precise forms of the invention shown and described herein. Accordingly, the present illustrations are not to be interpreted as restrictive of the invention beyond that necessitated by the following claims.

We claim:

1. The method of fitting an ophthalmic lens in a rim of a spectacles frame comprising the steps of:

measuring the perimeter of the inner edge of a said rim;

selecting an edging machine pattern having a profile accurately corresponding to an intended final contour of said inner perimeter of said rim and operatively adapting said pattern to apparatus for edging said lens;

adjusting said apparatus according to the relative perimetric sizes of said pattern and said measured inner perimeter of said rim, said adjustment being such as to effect edging of said lens to said inner perimetric size of said rim by grinding operation of said apparatus when said lens is operatively clamped in said apparatus;

clamping said lens in said apparatus and effecting said grinding operating;

removing said lens from said apparatus; and inserting said lens into said rim, causing said rim to assume the configuration of said edged lens profile.

2. The method according to claim 1 wherein said perimeter of said rim is measured with a roller.

3. A method according to claim 2 wherein said roller is held stationary relative to said rim of said frame and against said inner edge of said rim and said rim is rotated at least 360° relative to said roller for measuring said perimeter.

4. A method according to claim 2 wherein said rim of said frame is held stationary, said roller is urged against said inner edge of said rim and guided along said inner edge through at least a full 360° loop for measuring said perimeter.

5. The method according to claim 3 wherein said perimeter=q $d\pi$ where q=number of roller rotations and d=roller diameter.

6. The method according to claim 4 wherein said perimeter=$d\pi\ (q+1)$ where q=number of roller rotations and d=roller diameter.

7. The method according to claim 1 wherein said apparatus for edging includes a grinding wheel having an effective grinding edge and an adjustable pattern shoe engaged by said pattern when said pattern is operatively adapted to said apparatus, said pattern shoe being adjustable in height relative to said edge of said wheel whereby said adjustment of said apparatus according to relative sizes of said pattern and measured inner perimeter of said rim comprises adjustment of said height of said pattern relative to said edge of said wheel.

* * * * *